US009583823B2

(12) United States Patent
Tasker et al.

(10) Patent No.: US 9,583,823 B2
(45) Date of Patent: Feb. 28, 2017

(54) FOLDABLE RADOME

(71) Applicant: CommScope Technologies LLC, Hickory, NC (US)

(72) Inventors: Allan M. Tasker, Kirkcaldy (GB); Junaid ul Islam Syed, Kirkcaldy (GB); John S. Curran, Kirkcaldy (GB); Brian J. Lawson, Leven (GB)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/370,220

(22) PCT Filed: Jun. 25, 2014

(86) PCT No.: PCT/US2014/043979
§ 371 (c)(1),
(2) Date: Jul. 2, 2014

(87) PCT Pub. No.: WO2014/210086
PCT Pub. Date: Dec. 31, 2014

(65) Prior Publication Data

US 2016/0149297 A1 May 26, 2016

(51) Int. Cl.
*H01Q 1/42* (2006.01)

(52) U.S. Cl.
CPC ..... *H01Q 1/42* (2013.01); *H01Q 1/427* (2013.01); *H01Q 1/428* (2013.01)

(58) Field of Classification Search
CPC ..... H01Q 1/42; H01Q 1/427; H01Q 1/428
USPC ..... 343/872, 916
See application file for complete search history.

(56) References Cited

U.S. PATENT DOCUMENTS 3,618,112 A * 11/1971 Grove ..... H01Q 1/42 264/257
4,833,837 A * 5/1989 Bonneau ..... E04H 15/20 52/2.19
2011/0193763 A1 8/2011 Onweller et al.
2012/0274533 A1 11/2012 Bouguereau et al.
2013/0002515 A1* 1/2013 Hills ..... H01Q 1/42 343/872
2013/0082896 A1 4/2013 Renilson et al.
2013/0099991 A1 4/2013 Wright et al.

FOREIGN PATENT DOCUMENTS

FR 2544553 A1 10/1984

OTHER PUBLICATIONS

International Search Report and Written Opinion; Mailed Sep. 24, 2014 for corresponding PCT Application No. PCT/US2014/043979.

* cited by examiner

*Primary Examiner* — Hoanganh Le
(74) *Attorney, Agent, or Firm* — Myers Bigel, P.A.

(57) ABSTRACT

In one embodiment, a foldable radome sub-assembly for an antenna reflector dish has flexible material connected to a plurality of rigid rim segments. Connection elements (e.g., inserts) are configured to interconnect two adjacent rim segments, such that, with the connection elements applied, the radome sub-assembly is configured as a radome connectable to the antenna reflector dish, and, without the connection elements applied, the radome sub-assembly is foldable between adjacent rim segments. The foldable radome sub-assembly can be folded up for efficient storage and shipping, yet is easy to configure in the field into a rigid radome for attachment to an antenna reflector dish.

12 Claims, 12 Drawing Sheets

FOLDABLE RADOME

CROSS-REFERENCE TO RELATED APPLICATIONS

This application claims the benefit of the filing date of U.S. provisional application No. 61/839,990, filed on Jun. 27, 2013, the teachings of which are incorporated herein by reference in their entirety.

BACKGROUND

Field of the Invention

The present invention relates to antennas and, more specifically but not exclusively, to radomes for reflector antennas.

Description of the Related Art

This section introduces aspects that may help facilitate a better understanding of the invention. Accordingly, the statements of this section are to be read in this light and are not to be understood as admissions about what is prior art or what is not prior art.

Radomes are typically applied to the open end of reflector antennas to reduce wind load, improve antenna aesthetics, and/or seal/protect the feed assembly and/or reflector dish surfaces.

Prior radomes include rigid or semi-rigid dielectric polymer covers and flexible fabric covers held in tension across the open end of the reflector dish, for example, by a cord lattice and/or a plurality of springs. Rigid and semi-rigid polymer cover-type radomes may be expensive to manufacture and have a minimum dimension of the reflector dish opening which may be too large for cost-efficient transport. Flexible fabric radomes may be labor intensive to install and/or later remove to permit access to the reflector dish opening.

BRIEF DESCRIPTION OF THE DRAWINGS

Other embodiments of the invention will become more fully apparent from the following detailed description, the appended claims, and the accompanying drawings in which like reference numerals identify similar or identical elements.

DETAILED DESCRIPTION

Figure 1:
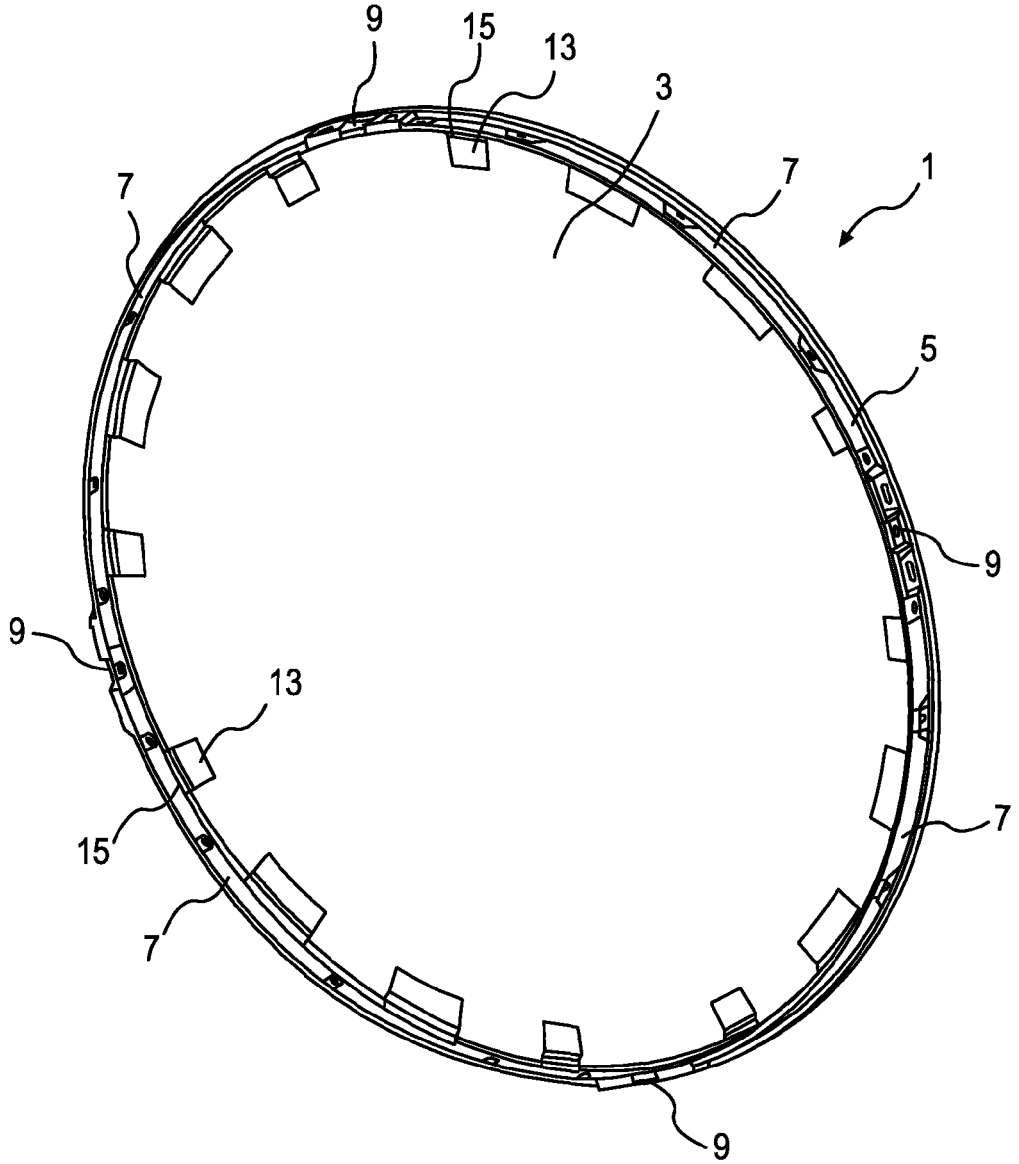
FIG. 1 is a schematic isometric view of an exemplary foldable radome.
Figure 2:
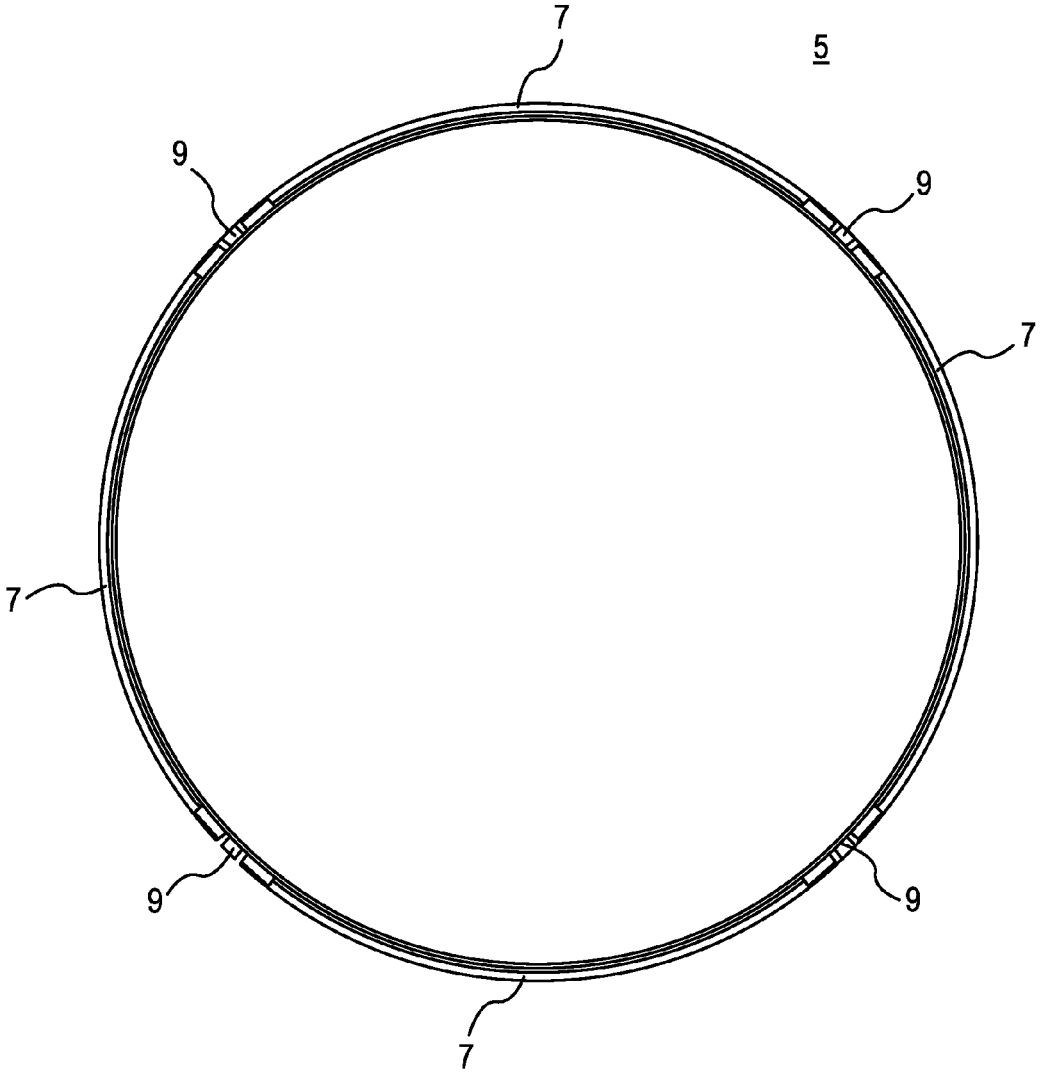
FIG. 2 is a schematic back view of the foldable radome of FIG. 1, face removed for clarity.
Figure 3:
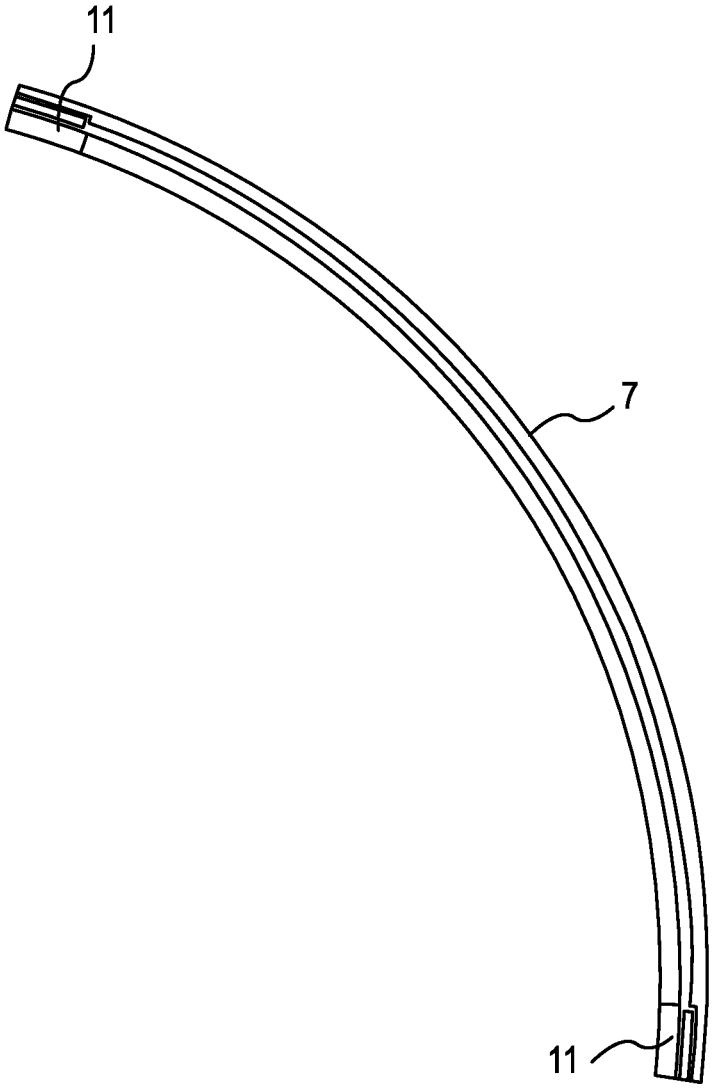
FIG. 3 is a schematic back view of a rim segment of the foldable radome of FIG. 1.
Figure 4:
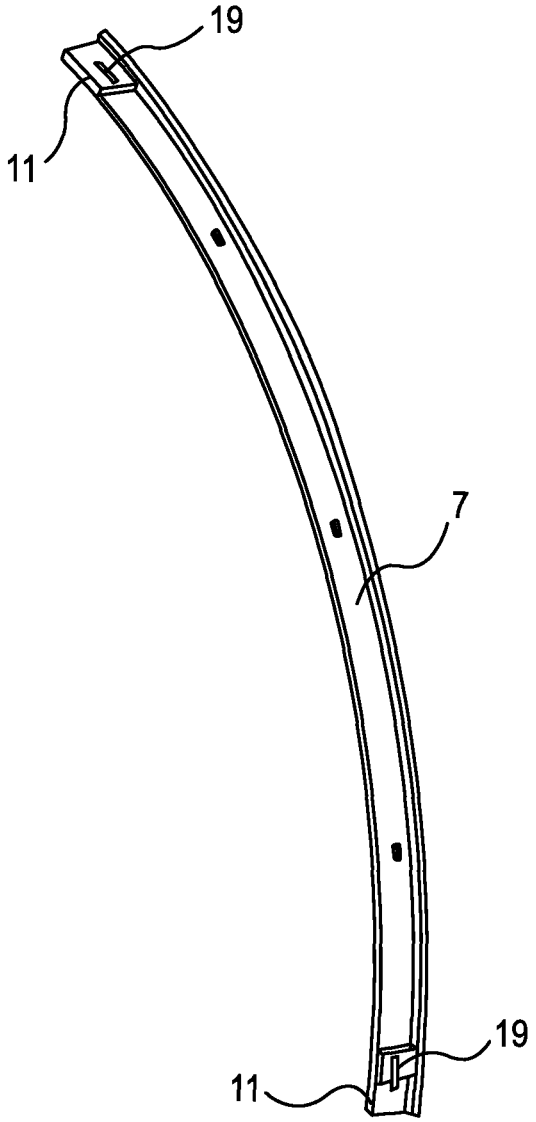
FIG. 4 is a schematic isometric view of the rim segment of FIG. 3.
Figure 5:
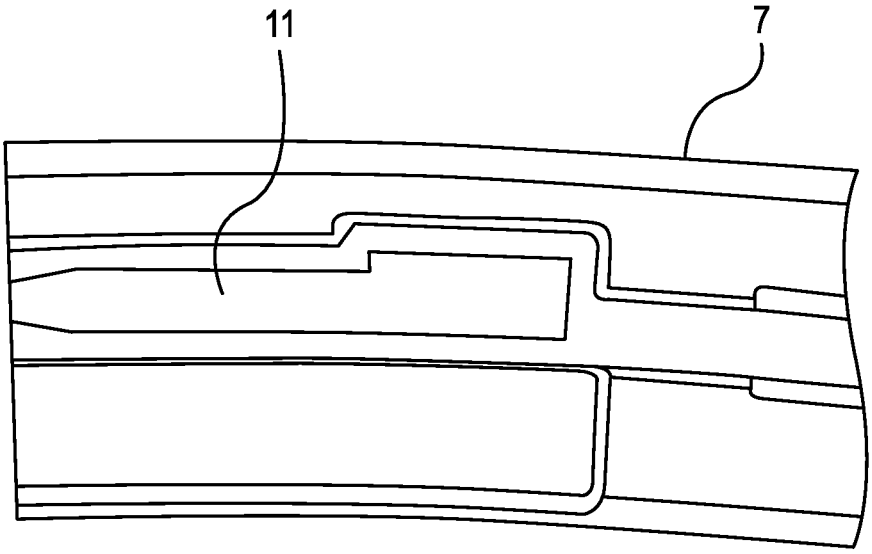
FIG. 5 is a close-up view of an end of the rim segment of FIG. 3.
Figure 6:
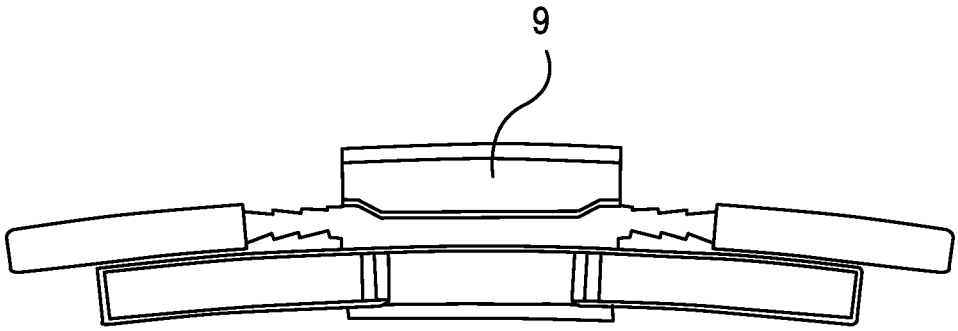
FIG. 6 is a schematic back view of an insert connector of the foldable radome of FIG. 1.
Figure 7:
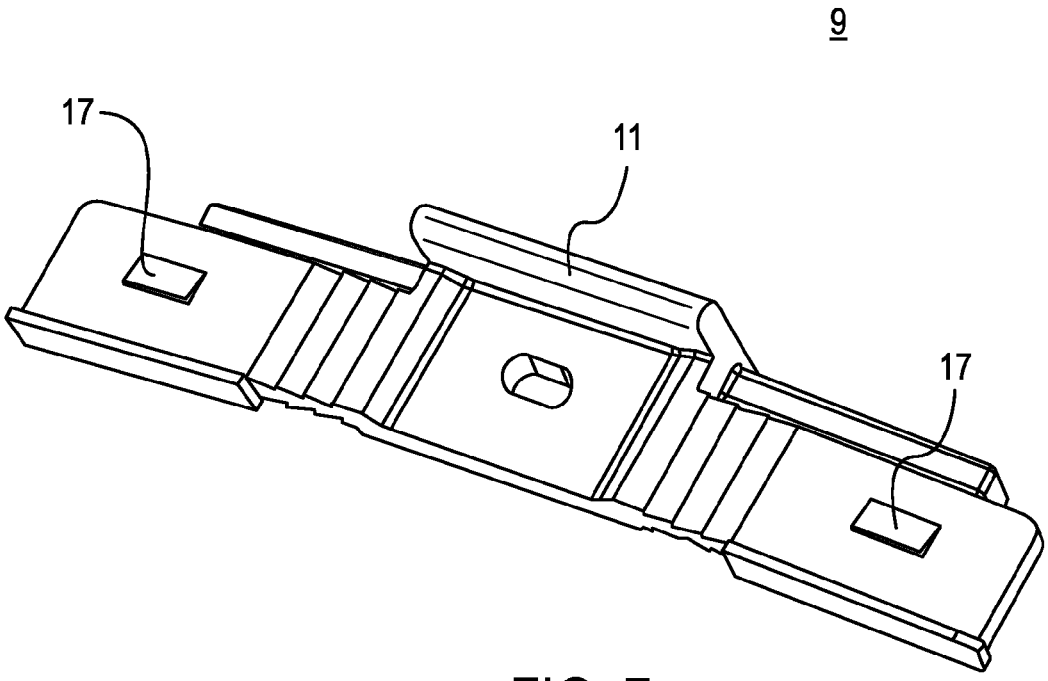
FIG. 7 is a schematic isometric view of the insert connector of FIG. 6.

As shown in FIGS. 1-9, a radome 1 with a face 3 of fabric material is provided with a supporting peripheral rim 5 for ease of installation and/or removal as an integral radome assembly. The peripheral rim 5 is formed from a plurality of (in this embodiment, four) rim segments 7 (see FIGS. 3 and 4), each adjacent pair of which may be joined end to end by an insert connector 9 (see FIG. 7) which snap fits into a connector seat 11, best shown in FIG. 5, provided at each end of the rim segments 7. In alternative embodiments, the number of rim segments 7 may be any suitable (e.g., even) number of rim segments greater than one.

The rim segments 7 and/or insert connectors 9 may be cost efficiently manufactured, for example, via injection molding of a suitable polymer material, such as (without limitation) polycarbonate.

Figure 8:
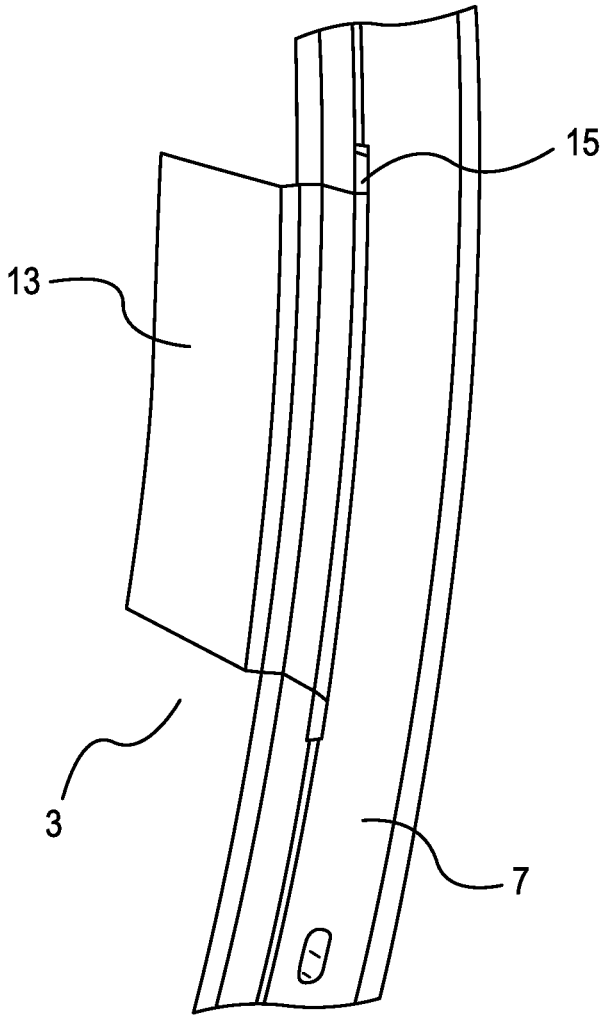
FIG. 8 is a close-up view of the foldable radome of FIG. 1, showing detail of the coupling of a radial tab to the radome face.
Figure 9:
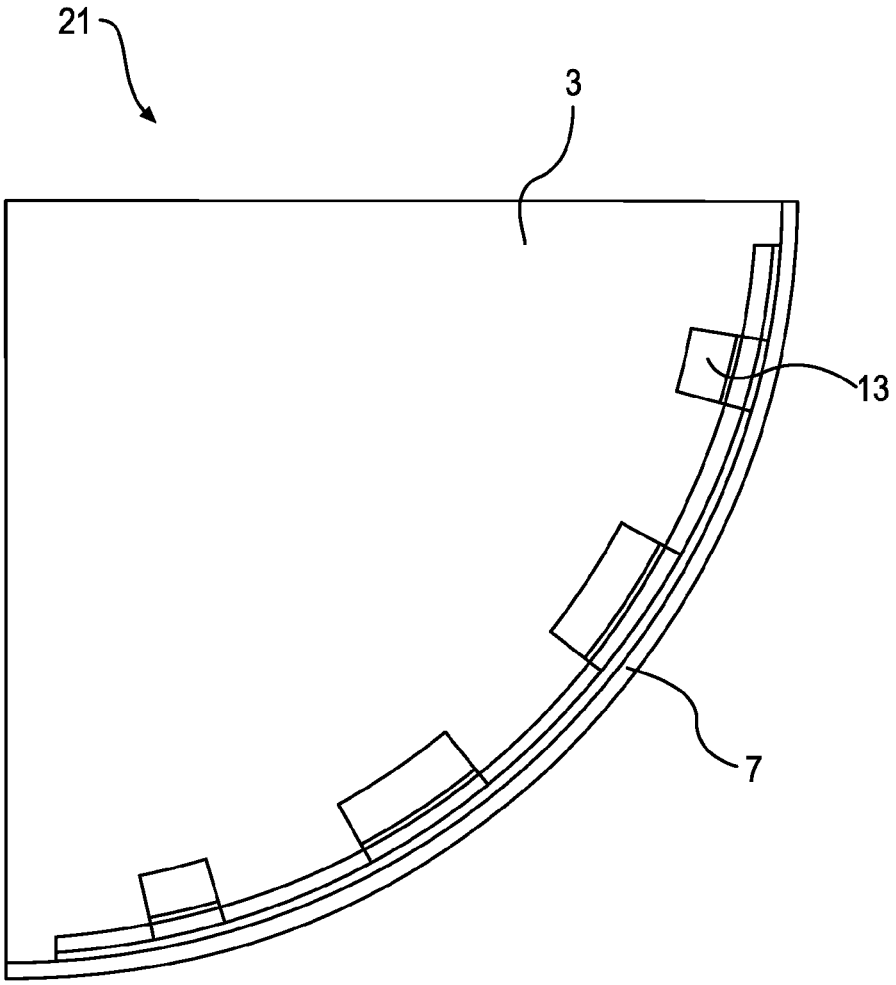
FIG. 9 is a back view of the foldable radome of FIG. 1, folded into a compact parcel.

As best shown in FIG. 8, the fabric material of the face 3 may be securely coupled to the rim segments by looping radial tabs 13 of the fabric material provided at the fabric material periphery around the rim segments 7, through tab slots 15 of the rim segments 7 and radially inward face to face with the fabric material of the face 3. The radial tabs 13 may be securely coupled to the fabric material of the face 3 by, for example, stud, heat fusing, adhesive, radio frequency or ultrasonic welding, or the like. Alternatively, the fabric of the face 3 may be coupled directly to the rim segments 7 by, for example, heat fusing, adhesive, radio frequency or ultrasonic welding, or the like. The attachment points are arranged and the fabric dimensioned therebetween to tension the face 3 upon assembly of the radome 1 to resist movement of the fabric material of the face 3 in response to winds or the like With the fabric material of the face 3 pre-attached to the rim segments 7, but the rim segments 7 not yet interconnected end to end, the rim segments 7 and face 3 may be collected into a compact parcel 21 by folding the face 3, for example, into quarters, and aligning the rim segments one upon the other, as shown, for example, in FIG. 9.

At the installation site, the compact parcel of the folded face 3 with attached rim segments 7 is unfolded, and the rim segments aligned spaced apart from one another for interconnection by snap fitting the insert connectors 9 into the connector seats 11 while pulling the rim segments 7 apart from one another, thereby tensioning the central portion of the face 3 between the rim segments 7.

The snap fit between the rim segments 7 and the insert connectors 9 may be, for example, via connection tabs 17 (FIG. 7) protruding from the insert connectors 9 which seat within corresponding sockets 19 (FIG. 4) or shoulders of the ends of the rim segments 7. Alternatively, a wedge shaped insert or cam system may be applied to tension the face 3.

Figure 10:
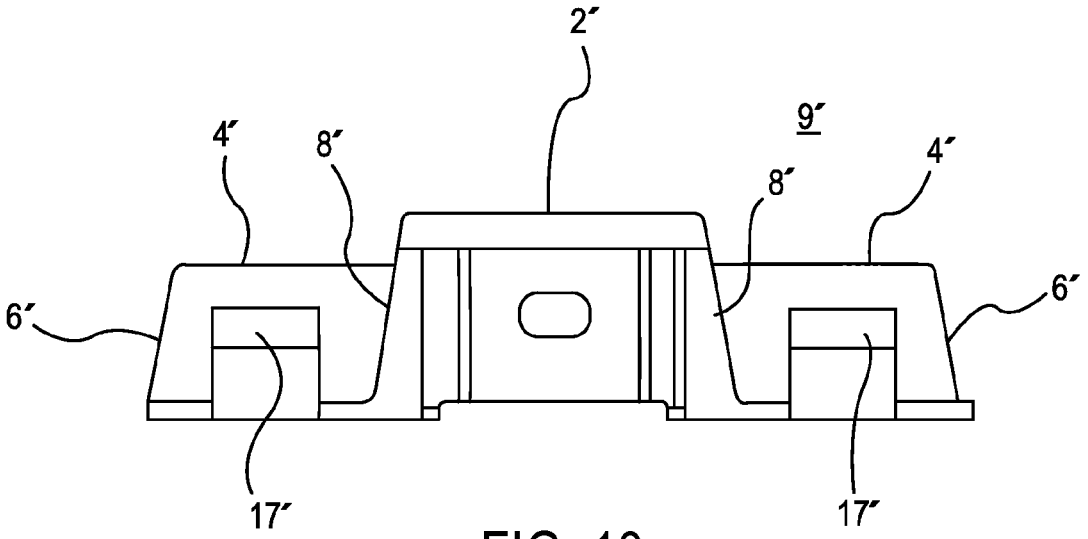
FIG. 10 is a side view of an alternative insert connector.
Figure 11:
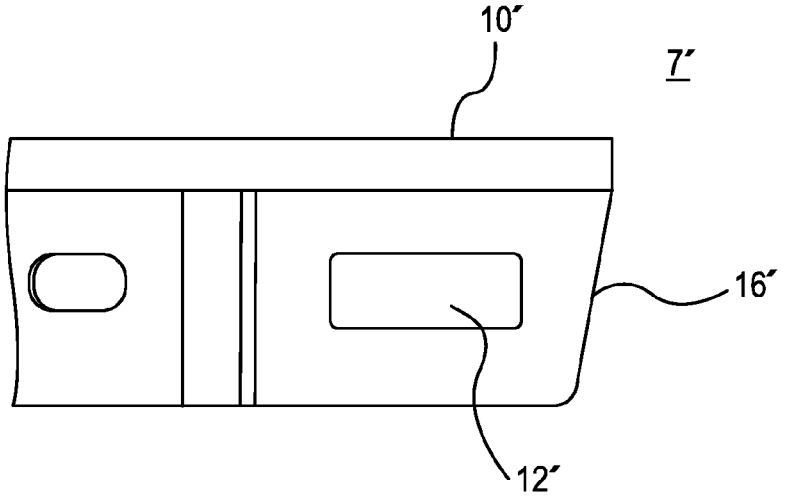
FIG. 11 is a side view of an alternative design for the ends of the peripheral rim segments.
Figure 12:
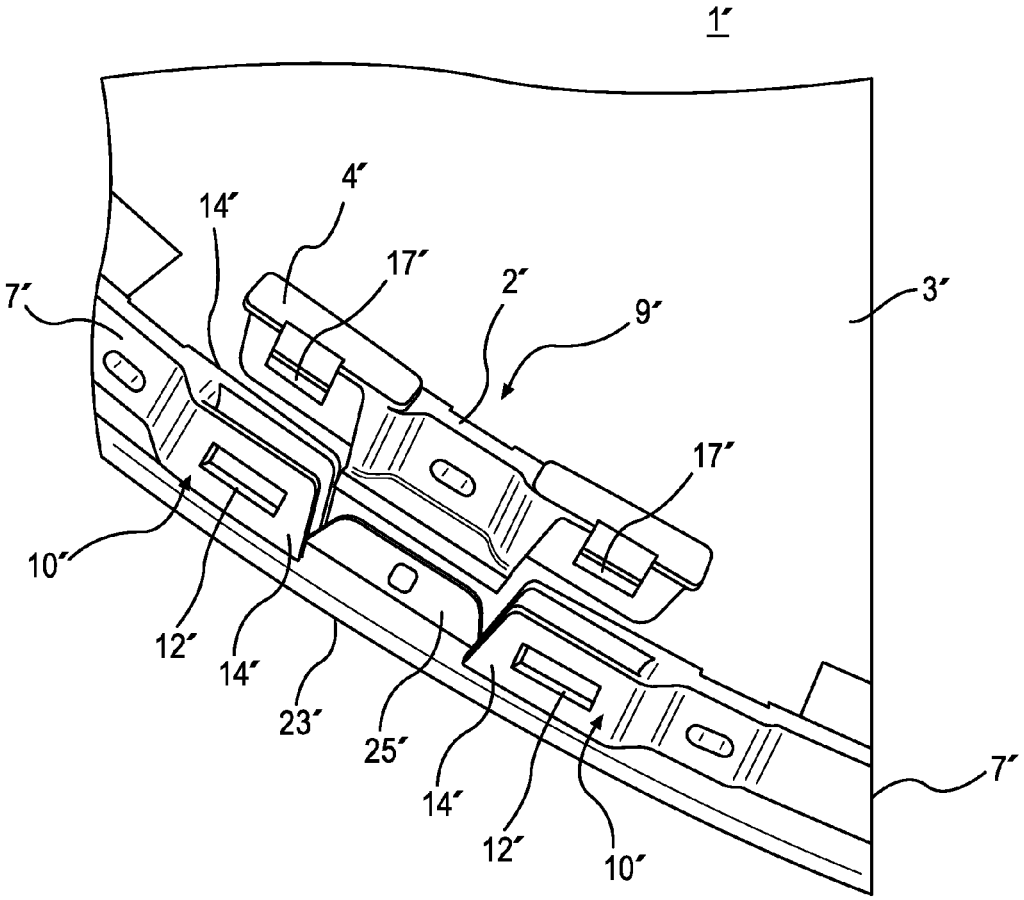
FIG. 12 is an isometric exploded view of the insert connect of FIG. 10 and the ends of two adjacent rim segments of FIG. 11.

FIGS. 10-12 represent an alternative scheme for interconnecting adjacent rim segments for a foldable radome. As shown in FIG. 10, insert connector 9' includes middle section 2' and two opposing wing sections 4', each having a flexible tab 17'. As shown in FIGS. 11 and 12, each rim segment 7' has a slotted end 10' having two side walls 14', one of which has an opening 12' designed to receive flexible tab 17' of insert connector 9'. Actually, each rim segment 7' has two slotted ends 10', one on each end, for connecting to two other rim segments 7'.

As best seen in FIG. 12, to secure two adjacent rim segments 7 together, each wing section 4' of insert connector 9' is inserted into the slotted end 10' of one of the rim segments 7' until its flexible tab 17' is received within the corresponding opening 12' in a snap-fit manner, thereby securing insert connector 9' in place and maintaining the circumferential alignment between the two rim segments 7'.

As shown in FIGS. 10 and 11, the outer edges 6' of the wing sections 4' and the outer walls 8' of the middle section 2' of insert connector 9' are slanted, and the outer edge 16' of each slotted end 10' of each rim segment 7' is similarly slanted, such that, as insert connector 9' is inserted into the slotted ends 10' of two adjacent rim segments 7' (as best seen in FIG. 12), the slanted structures of the insert connector 9' engage corresponding structures on the two rim segments 7' to push the rim segments 7' further apart, thereby increasing the circumference and the diameter of the radome assembly and stretching the radome fabric to achieve a desired level of tension within the radome face 3'. FIG. 12 also shows portions 23' and 25' of the fabric material that forms radome face 3'. Portion 23' is part of the fabric material that wraps around the radome rim, while portion 25' is a tab of fabric material that aligns with and is fastened to the hole in middle section 2' of insert connector 9' in order to keep the radome face 3' from flapping in the wind.

Figure 13A:
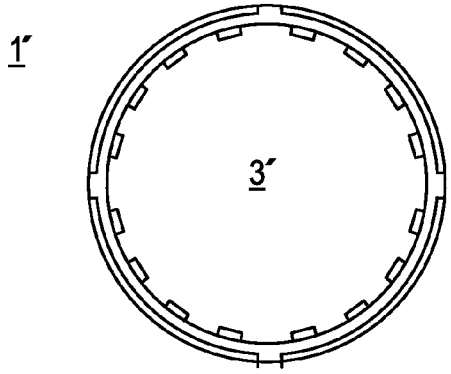
FIGS. 13A-13D show a sequence of exemplary steps involved in folding an exemplary foldable radome of the present disclosure.
Figure 13B:
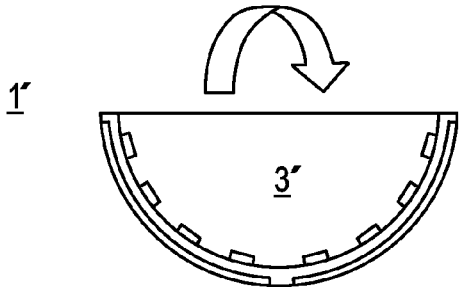
Figure 13C:
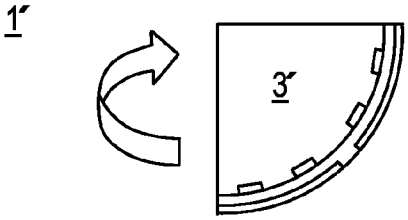
Figure 13D:
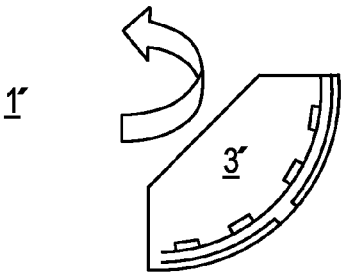
Figure 14:
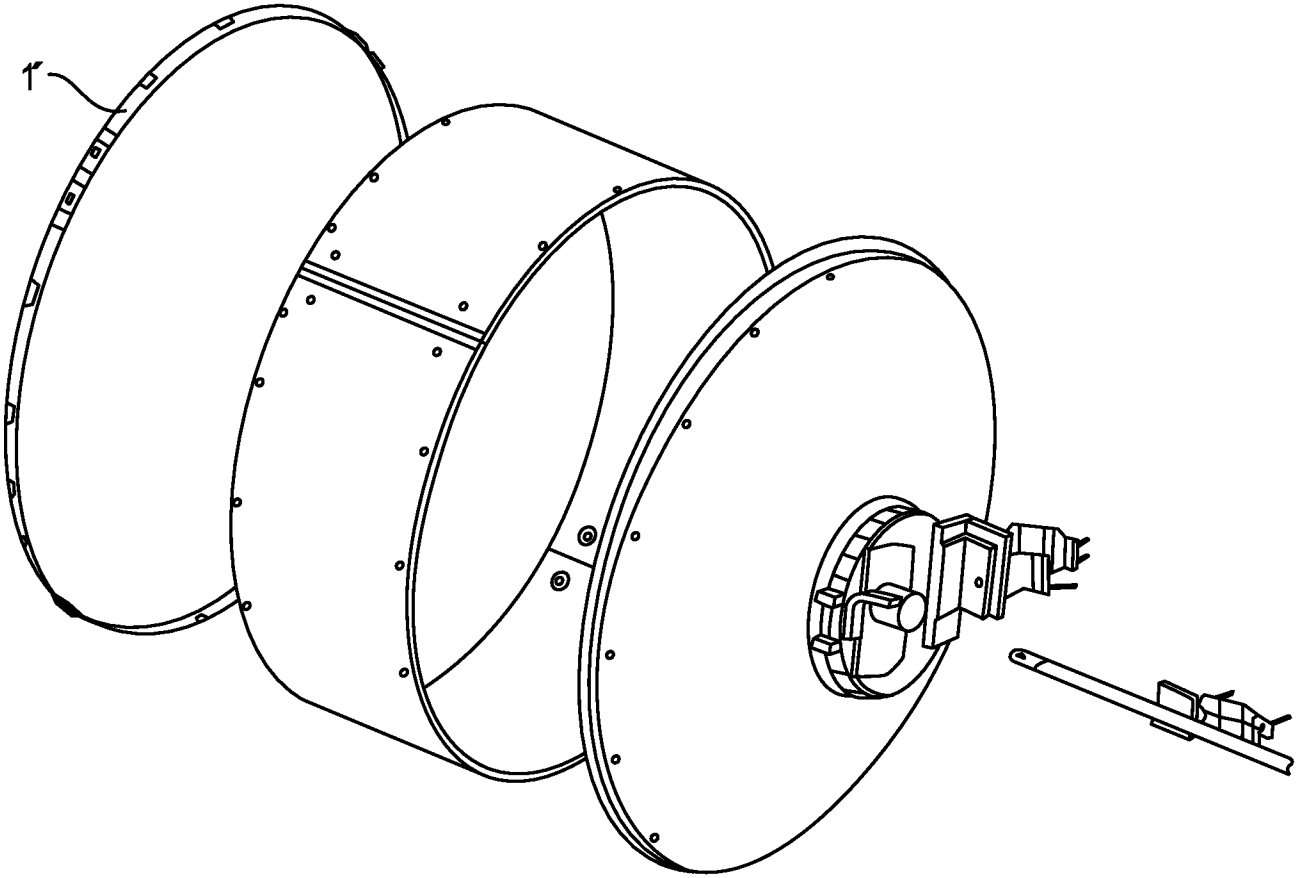
FIG. 14 is an isometric exploded view of a reflector antenna configured with a foldable radome 1' of the present disclosure.

Referring to FIGS. 13A-13D, the foldable radome 1' of FIG. 13A (with no connection inserts applied) can be folded in half (as in FIG. 13B) and then in half again (as in FIG. 13C). The folded fabric face 3' can then be folded (as in FIG. 13D) to provide an even smaller folded assembly. One skilled in the art will appreciate that the foldable radomes of this disclosure, like radome 1', provide improvements in pre-assembly area, which may reduce inventory and/or shipping costs. Further, the total material requirements may be reduced with respect to traditional rigid and semi-rigid radome configurations, without significantly increasing installation labor requirements.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A foldable radome for an antenna reflector dish, the foldable radome comprising:
- a radome sub-assembly comprising:
  - a plurality of rigid rim segments; and
  - flexible material connected to the rim segments; and
- a plurality of connection elements, each configured to interconnect two adjacent rim segments, such that:
  - with the connection elements applied, the radome sub-assembly is configured as a radome connectable to the antenna reflector dish; and
  - without the connection elements applied, the radome sub-assembly is foldable between adjacent rim segments,
- wherein each connection element is configured such that a diameter of the radome sub-assembly increases as each connection element engages the two adjacent rim segments to remove slack in the flexible material, and
- wherein one or both of the connection elements and the rim segments have angled surfaces configured to engage corresponding surfaces to increase the diameter of the radome sub-assembly.

2. The foldable radome of claim 1, wherein both the connection elements and the rim segments have the angled surfaces.

3. The foldable radome of claim 1, wherein each connection element is configured such that the connection element locks into place after being applied to the two adjacent rim segments.

4. The foldable radome of claim 3, wherein each connection element locks into place using snap-fit mechanisms.

5. The foldable radome of claim 1, wherein each rim segment comprises a number of slots for receiving tabs of the flexible material by which the flexible material is secured to the rim segment.

6. The foldable radome of claim 1, wherein the radome sub-assembly comprises four rim segments, such that:
- with the connection elements applied, the radome sub-assembly is configured as a circular radome; and
- without the connection elements applied, the radome sub-assembly is foldable into a single quadrant shape.

7. A method of assembling a radome for an antenna reflector dish, the method comprising:
- (a) providing a foldable radome sub-assembly in a folded configuration, the foldable radome sub-assembly comprising:
  - a plurality of rigid rim segments; and
  - flexible material connected to the rim segments;

(b) unfolding the foldable radome; and (c) applying a connection element to each pair of adjacent rim segments to configure the radome sub-assembly into the radome connectable to the antenna reflector dish, wherein each connection element is configured such that a diameter of the radome sub-assembly increases as the connection element engages the pair of adjacent rim segments to remove slack in the flexible material, and wherein one or both of the connection elements and the rim segments have angled surfaces configured to engage corresponding surfaces to increase the diameter of the radome sub-assembly.

8. The method of claim 7, wherein both the connection elements and the rim segments have the angled surfaces.

9. The method of claim 7, wherein each connection element is configured such that the connection element locks into place after being applied to the pair adjacent rim segments.

10. The method of claim 9, wherein each connection element locks into place using snap-fit mechanisms.

11. The method of claim 7, wherein each rim segment comprises a number of slots for receiving tabs of the flexible material by which the flexible material is secured to the rim segment.

12. The method of claim 7, wherein the radome sub-assembly comprises four rim segments, such that:

with the connection elements applied, the radome sub-assembly is configured as a circular radome; and without the connection elements applied, the radome sub-assembly is foldable into a single quadrant shape.

* * * * *